United States Patent [19]

Boots

[11] Patent Number: 4,927,037

[45] Date of Patent: May 22, 1990

[54] CONTAINER FOR FLUIDS, SOLIDS HAVING FLOW PROPERTIES OF THE LIKE

[76] Inventor: Gerardus A. M. Boots, Boskriek 72, 5401 LP Uden, Netherlands

[21] Appl. No.: 249,869

[22] Filed: Sep. 27, 1988

[30] Foreign Application Priority Data

Sep. 30, 1987 [NL] Netherlands ..... 8702331

[51] Int. Cl.[5] ..... B65D 90/16; B65D 90/20

[52] U.S. Cl. ..... 220/1.5; 206/386; 217/36; 220/403; 229/23 C

[58] Field of Search ..... 220/1.5, 416, 403, 461–463; 206/320, 386, 592, 594; 217/36; 229/23 C, 23 R, 41 R

[56] References Cited

U.S. PATENT DOCUMENTS

| | | | |
|---|---|---|---|
| 2,275,332 | 3/1942 | Wilson | 217/36 |
| 2,693,895 | 11/1954 | Elmendorf | 229/23 C |
| 2,910,221 | 10/1959 | Whiton | 229/23 C |
| 3,136,472 | 6/1964 | Waller et al. | 229/23 C |
| 3,371,815 | 3/1968 | Macomber | 220/1.5 |
| 3,494,535 | 2/1970 | Acker | 229/23 R |
| 4,166,569 | 9/1979 | Begnaud et al. | 229/23 C |
| 4,426,015 | 1/1984 | Preston et al. | 220/403 |
| 4,585,143 | 4/1986 | Fremow et al. | 229/23 C |
| 4,742,951 | 5/1988 | Kelly et al. | 229/23 R |

FOREIGN PATENT DOCUMENTS

| | | | |
|---|---|---|---|
| 1400414 | 7/1975 | United Kingdom | 206/386 |

*Primary Examiner*—Jimmy G. Foster

[57] ABSTRACT

A container for fluids, solids having flow properties or the like, and comprising a box of a conventional packing material, such as cardboard, a supporting frame of a material that is stronger and of greater dimensional stability, such as wood, and an inner bag (4) of a conventional packing material, such as a flexible synthetic plastics, for containing the material being packed. The container comprises four opposed frame sidewalls (1, 2), each including a pressure face (8, 13) extending the full height of the respective sidewall. A sleeve (3) of a relatively thin material having a high tensile strength and relatively low stretch, such as paper, a ribbon fabric of plastics, or the like, is provided to extend on the outside of, and around, the pressure faces (8, 13), and from one side of a pressure face (8, 13) substantially direct to the adjacent side edge of the pressure face (13, 8) of the adjacent sidewall, thus cutting the frame corners.

9 Claims, 1 Drawing Sheet

CONTAINER FOR FLUIDS, SOLIDS HAVING FLOW PROPERTIES OF THE LIKE

Figure 1:
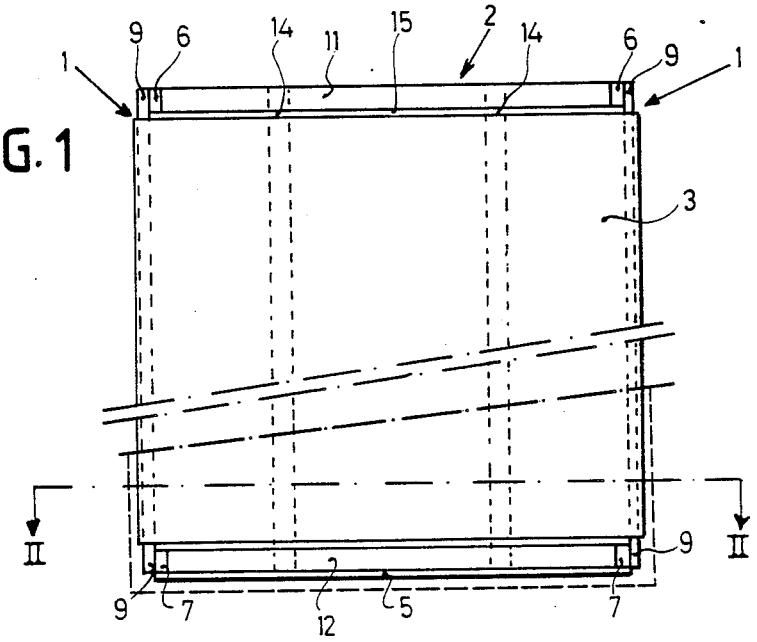

This invention relates to a container for fluids, solids having flow properties or the like, of the kind comprising a box of a conventional packing material, such as cardboard, a supporting frame of a material that is stronger and of greater dimensional stability, such as wood, and an inner bag of a conventional packing material, such as a flexible synthetic plastics, for containing the material being packed.

With a container of this kind, problems may occur as a result of bulging of the box sidewalls, in spite of the provision of the supporting frame. Bulging has various disadvantages. Major disadvantages are a decrease in effectively utilizing transport volume, and an increase in the risk of damage to the container. The reduction in transport volume to be effectively used is a result of the fact that bulges prevent boxes being placed in close surface-to-surface contact with each other, so that voids are formed between boxes placed next to each other. Especially in the case of long transport routes, for example, by sea, this can be a considerable disadvantage which greatly increases the cost of transport, certainly in the case of materials to be shipped under particular conditions, for example, in refrigerated spaces. The increased risk of damage is a result of the bulging walls, which are often made of a less strong material, for example, cardboard, projecting outside of the supporting frame. Damage to that wall may rapidly lead to damage to the inner bag as well, which is pressed against the box wall by the packed material, so that the materials packed are released and become lost. To prevent these adverse effects the art has already resorted to measures which make the manufacture of the container considerably more complicated and expensive, such as covering the supporting frame with sheeting material of relatively high strength, such as wood products, or making double walls with cavities between them, which it is true reduce the risk of damage, but reduce the effective shipping space and in addition complicate the design and manufacture of the box and make these more expensive. Covering the supporting frame with relatively rigid and strong members does reduce the useful shipping space to a lesser extent, but is considerably more expensive and in addition adds to the weight of the container, which is less desirable from the point of view of shipping.

It is an object of the present invention to improve a container of the kind described in such a manner as to produce a reliable, non-bulging construction by a small number of relatively inexpensive means, and minimizing ineffective shipping volume.

This is achieved, according to the present invention, by providing a container of the kind described which is characterized in that four opposed frame sidewalls each include a pressure face extending the full height of the respective sidewall but having a width less than that of the respective sidewall, and a sleeve of a relatively thin material of high tensile strength and relatively low stretch, such as paper, a ribbon fabric of plastics, or the like is provided to extend on the outside of, and around, the pressure faces, and from one side of a pressure face substantially direct to the adjacent side edge of the pressure face of the adjacent sidewall, thus cutting the frame corners.

By virtue of these measures, a construction is obtained which when filled with a fluid tensions and stiffens itself owing to the pressure exerted by the material introduced into the inner bag. This beneficial effect is the result of the provision of the sleeve, which limits and correlates the outward deflection of the pressure faces. The circumference of the sleeve in loaded condition dictates how far the pressure faces can move outwards, whereby the sleeve is only subjected to tensile loads and thus can be made from a light and thin material, such as paper. Voids only form in the corners of the box, that is to say, at the places where the sleeve extends cutting the frame corners. These corner regions are as small as possible and distributed as effectively as possible in a further embodiment of the present invention, in which the pressure faces leave, on their two sides, equal parts of the frame sidewalls uncovered. If desired, stiffening members, for example, for enhancing the stacking strength, may be provided in the corners.

The pressure faces are to be seen as determinative of the outer faces of the container. To keep the outer faces flat, the pressure faces may take the form of relatively rigid, non-budging elements. It is true that one of the disadvantages of the known stiffening constructions is again partly introduced, namely the use of a more expensive, heavier material. Preferably, therefore, and in accordance with a further embodiment of the present invention, the pressure faces are made of a thin material of high tensile strength and relatively low stretch, such as paper, which pressure faces are kept at least locally spaced from the sleeve by interposed rigid support members, for example, wooden strips.

In a further advantageous manner, the rigid support members form the horizontal and vertical parts of the support frame in a further preferred embodiment of the invention, in which the frame comprises four basically independent frame walls each composed of a pressure face and at both the top and the bottom of the pressure face rigid frame edge members projecting from the pressure face on opposite sides thereof a distance corresponding with the desired peripheral dimensions of the frame. This construction is rendered possible by the use of the sleeve, which forms the connecting element for the four pressure faces and hence the support frame sidewalls. This embodiment has the further, additional and particular advantage that the container can be supplied in flat collapsed condition at the site where the container is to be filled, and no carpentry work is needed to obtain a firm support frame. To the extent this has not yet been done, the support frame sidewalls only need to be shifted into the sleeve; the desired strength of the whole is automatically obtained as the container is being filled.

When, in accordance with a further embodiment of the invention, at both the top and the bottom, one pair of opposed frame edge members have such a length that their end faces abut with the inner sides of the other pair of opposed frame edge members, the container can be set up or unfolded into a first rough form, which facilitates its filling to produce the ultimate desired form and strength. Both this initial shaping and the realization of the ultimate desired shape during filling is influenced in an advantageous manner when, in accordance with a further embodiment of the present invention, the ends of said one pair of frame edge members can slide along the inner sides of said other pair of frame edge members. To optimize the pattern of forces it is preferable, in this embodiment, that the support members connected to said one pair of frame edge members are secured thereto on the inside thereof and the support members connected to said other pair of frame edge members are secured thereto on the outside thereof. Owing to these features, the pressure faces carrying said one pair of frame edge members are pressed outwardly during filling, and the pressure faces carrying the other pair of frame edge members are loaded inwardly by the sleeve, the result of which is that, as the container is being filled, the frame edge members are going to reach their ultimate desired position and finally, in their end position determined be the sleeve, are positively pressed together by the same sleeve, and thus are locked in a rectangular bracing, which basically does not require fixing the frame edge members by fastening means.

In order to enhance the stacking strength and to reduce the risk of damage to the bottom of the container, it may in certain cases be preferable that, at the bottom, the frame edge members of said other pair are each secured to a plate-like bottom of a rigid material, such as wood. In a construction with support frame walls which are independent from each other and have sliding frame edge members, the plate-like bottom can be placed in position at any desired moment without adversely affecting, or preventing, the desired operation of the container during filling. Naturally, a plate-like cover can further be provided after the completion of the filling operation.

Figure 2:
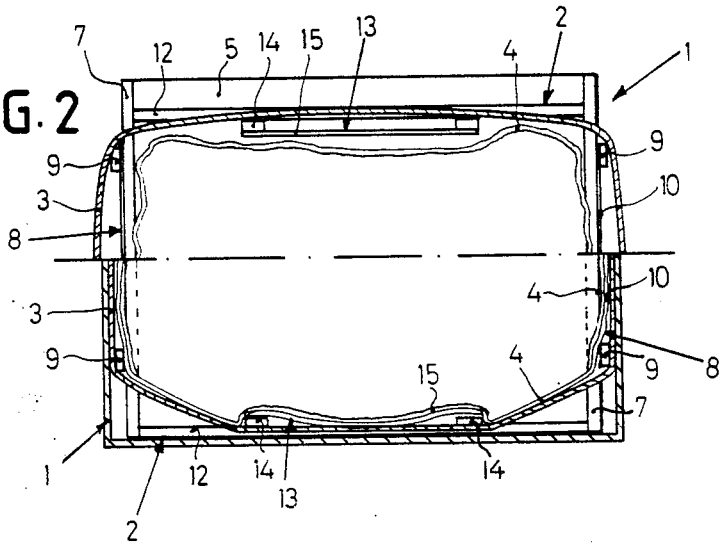

One embodiment of a container according to the invention will now be discussed and elucidated in more detail, by way of example, with reference to the accompanying drawings. In said drawings, FIG. 1 shows a container according to the present invention in front-elevational view, omitting an enveloping box; and FIG. 2 shows a cross-sectional view taken on the line II—II of FIG. 1, showing the container in non-filled condition in the upper half of the Figure, and in the filled condition in the lower half.

In order that the construction and operation of the various parts of the container may be better understood, the container is shown in the drawings without a box which normally, at least in the shipping situation, envelops it, which is made of a conventional packing material, such as cardboard or the like. Forming part of the container shown, therefore, is a universally known rectangular box which can be made in any given known manner, and is therefore not described in any further detail herein.

The parts of the container shown in the drawings comprise a first pair of opposing walls 1, a second pair of opposing walls 2, extending at right angles to the first pair of walls 1, a sleeve 3, an inner bag 4 and a bottom plate 5.

Walls 1 are each composed of an upper frame edge member 6 and a lower frame edge member 7, which all have a length corresponding to an inner main dimension of an enveloping box, in the present case the shorter legs, as viewed in cross-section of the box. Extending vertically between each pair of upper and lower frame edge members is a pressure face 8, built up from two support members 9, between which a layer 10 of paper is tensioned. The support members are positioned on the outsides of the frame edge members 6 and 7 and secured thereto with the layer 10 between them.

Walls 2 are also composed each of an upper frame edge member 11 and a lower frame edge member 12, all having a length which together with the thickness of the two frame edge members 6, 7, corresponds with an inner main dimension of an enveloping box, in the present case the longer leg, as viewed in cross-section, of the box. Extending vertically between each pair of upper and lower frame edge members is a pressure face 13, built up from two support members 14, between which a layer 15 of paper is tensioned. Support members 14 are secured to the inner sides of the frame edge members 11 and 12, with layer 15, in turn, being secured to the inside of support members 14.

FIG. 2 shows tow different situations. In the upper half, the starting position prior to filling, and in the lower half, the situation after filling are shown. With particular reference to the upper half of FIG. 2, it is noted that the four walls 1 and 2 are basically independent of each other and of sleeve 3, which means that the four walls can in fact each be removed independently from sleeve 3, so that the container can be supplied to the filling site in fully flat condition, which shipping advantage is not nullified by the enveloping box, which, as is well known, can also be supplied in flat condition. With particular reference to FIG. 2, there will now follow a more detailed description of what happens with the container as it is being filled.

Depending on the condition in which the container is supplied to the filling site, it should first be set up until the position shown in the upper half of FIG. 2 is realized. Examples of operations to be performed for this purpose are inserting the four independent walls 1 and 2 into the sleeve, placing the frame edge members 11 and 12 at right angles to, and within, the frame edge members 6 and 7, placing the inner bag 4 in the space surrounded by walls 1 and 21 and, if desired, fastening the lower frame edge members 7 to the bottom plate 5.

When the container has thus been set up, its filling can be started by introducing the material being packed into the inner bag 4. Owing to the material introduced, the inner bag 4 is stretched and thus comes into contact with the pressure faces 8 and 13 as well as with sleeve 3. According as more material is contained within inner bag 4, this bag, which has hardly, if at all, any stiffness of its own, tends to move further outwardly, the result of which is that in particular the pressure faces are loaded. As a consequence, the pressure faces 13 will move from the position shown in the upper half of FIG. 2 to the position shown in the lower half, whereby the sleeve 3, which initially extended loosely around walls 1 and 2, is gradually being tensioned until the position shown in the lower half of FIG. 2 is reached, in which the frame edge members 6 and 11, and 7 and 12, form a rectangular upper and lower support frame, and sleeve 3 is tautly in its tensioned position and in fact cannot be deflected any further. In that position, the pressure faces 8 and 13 have been deformed into a slight outward deflection, as shown in the lower half of FIG. 2, without, however, forming any objectionable bulges outside the circumference of the container.

The position shown in the lower half of FIG. 2 can be reached from that shown in the upper half by virtue of the ends of the frame edge members 11 and 12 sliding along the inner sides of frame edge members 6 and 7. In this way, the pressure faces 13 are pressed outwardly during filling, which outward movement is counteracted, from a given moment, by the sleeve as it is gradually brought under tension, and which in turn is limited in its possibilities of movement by the support members 9 connected to the frame edge members 6 and 7, which are kept at a fixed spaced interrelationship by the frame edge members 11 and 12. During the deflection of the pressure faces 13, the frame edge members 6 and 7 are pulled together by the tensioned sleeve 3 which, in this way, provides for a stiffening of the container which in principle is composed of loose parts. As shown in the lower half of FIG. 2, the inner bag 4 will ultimately closely conform to the shape of the pressure faces 8 and 13 and, between these pressure faces, the shape of sleeve 3. When the container has been filled to completion, the inner bag is closed in a fluid-tight manner, which is effected by sealing or any different method depending on the material of the inner bag. There is thus obtained a container which, except for four small corner regions, can fill a rectangular cross-section without exhibiting bulges. It will further be clear that the container shown in the lower half of FIG. 2 can be shifted into an enveloping rectangular box of suitable dimensions without any problems, which box may be of relatively light construction because it need not absorb any forces from the packaged material, which in fact are fully taken up in the construction shown in FIG. 2. It will thus also be clear that the box will not be going to exhibit any bulges either, so that optimum stacking in a shipping space can be effected. Support members 9 and 14, and frame edge members 6, 7, 11 and 12 will generally impart sufficient stiffness and strength to the container for it to withstand stacking forces. In cases where additional reinforcement would be required, this can be realized in a simple manner by sliding such reinforcements and rigidifications into the corner regions, which remain free, after filling the container.

Naturally, many modifications and variants are possible without departing from the scope of the invention. Thus the frame edge members may all be of shorter length, for example, not longer than the width of the associated pressure face, whicb in turn could consist of a plate-like member, so that the construction need not necessarily present separate support members and frame edge members. Furthermore, a plate-like cover member, similar to the plate-like bottom member 5 could be provided. This latter is of course also possible for that matter, in the construction shown in the accompanying drawings. Furthermore, the various parts can be made of any given suitable material. If desired for considerations of strength and stiffness, it is equally possible to provide further intermediate frame edge members between the upper and lower frame edge members. The same applies of course with regard to the support members.

What I claim is;

1. A container for fluids, solids having for properties, or the like comprising a box of a conventional packing material, a supporting frame inside the box and of a material that is at least in part stronger and of greater dimensional stability than said conentional packing material, and an inner bag inside the frame and of a conventional flexible packing material for containing the material being packed, said supporting frame including four opposed frame sidewalls each having a pressure face extending the full height of the respective side wall but having a width less than that of the respective sidewall, and said container further comprising a sleeve of a relatively thin material of high tensile strength and relatively low stretch extending on the outside of, and around the pressure faces, and from one side of a pressure face substantially directly to the adjacent side edge of the pressure face of the adjacent sidewall, the circumference of said sleeve being less than the outer circumference of the supporting frame.

2. A container according to claim 1, wherein the circumference of the sleeve is equal to the widths of the four pressure faces plus the distances between the side edges of each two adjacent pressure faces in a filled condition of the container.

3. A container according to claim 1, wherein each pressure face is centered on its respective side wall so as to leave equal parts on each side of the side wall uncovered.

4. A container according to claim 1, wherein the pressure faces are made of a thin material of high tensile strength and relatively low stretch, and are kept at least locally spaced from the sleeve by interposed rigid support members attached to the supporting frame.

5. A container according to claim 1, wherein said side walls are independent of each other and each have at both a top and a bottom of its respective pressure face rigid frame edge members projecting from the pressure face on opposite sides thereof a distance corresponding with the desired peripheral dimensions of the supporting frame.

6. A container according to claim 5, wherein at both a top and a bottom of the supporting frame, one pair of opposed frame edge members have such a length that end faces thereof abut with inner sides of the other pair of opposed frame edge members.

7. A container according to claim 6, wherein said one pair of frame edge members is movable independently of the other pair of frame edge members, whereby the ends of said one pair of frame edge members can slide along the inner sides of said other pair of frame edge members.

8. A container according to claim 6, wherein there are support members for the pressure faces, the support members associated with said one pair of frame edge members are connected thereto on the inside of said supporting frame and the support members associated with said other pair of frame edge members are connected thereto on the outside of said supporting frame.

9. A container according to claim 6, wherein at the bottom, the frame edge members of said other pair are each secured to a plate-like bottom of a rigid material.

* * * * *